US011339518B2

(12) United States Patent
Ji et al.

(10) Patent No.: US 11,339,518 B2
(45) Date of Patent: May 24, 2022

(54) REMOTE CONTROLLABLE LAUNDRY PROCESSING DEVICE AND CONTROL METHOD THEREOF

(71) Applicant: LG ELECTRONICS INC., Seoul (KR)

(72) Inventors: Baekgeun Ji, Seoul (KR); Yongwoon Jang, Seoul (KR); Jeongwon Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 16/923,826

(22) Filed: Jul. 8, 2020

(65) Prior Publication Data

US 2021/0017687 A1 Jan. 21, 2021

(30) Foreign Application Priority Data

Jul. 17, 2019 (KR) ..... 10-2019-0086424

(51) Int. Cl.

| | |
|---|---|
| ***D06F 34/05*** | (2020.01) |
| ***D06F 33/32*** | (2020.01) |
| ***D06F 34/20*** | (2020.01) |
| ***D06F 34/28*** | (2020.01) |
| *D06F 103/40* | (2020.01) |
| *D06F 101/20* | (2020.01) |

(52) U.S. Cl.

CPC ..... *D06F 34/05* (2020.02); *D06F 33/32* (2020.02); *D06F 34/20* (2020.02); *D06F 34/28* (2020.02); *D06F 2101/20* (2020.02); *D06F 2103/40* (2020.02)

(58) Field of Classification Search

CPC ..... D06F 34/05

See application file for complete search history.

(56) References Cited

FOREIGN PATENT DOCUMENTS

| | | |
|---|---|---|
| EP | 3045579 | 7/2016 |
| EP | 3252204 | 12/2017 |
| WO | WO2018161782 | 9/2018 |

OTHER PUBLICATIONS

Extended European Search Report in European Appln. No. 20184369.5, dated Oct. 7, 2020.

*Primary Examiner* — Jason Y Ko

(74) *Attorney, Agent, or Firm* — Fish & Richardson P.C.

(57) ABSTRACT

A remote controllable laundry processing device includes: a cabinet main body including a door, a sensor unit configured to sense a locked state of the door, a manipulation unit provided for user input, a remote control setting unit configured to control the laundry processing device based on an external terminal, a controller configured to control an operation of the laundry processing device, and a communication unit configured to send the controller an input signal from the external terminal. The controller is configured, based on the door being in the locked state and regardless of whether a remote control has been set by the remote control setting unit, to control the laundry processing device in response to a first input signal from the manipulation unit and a second input signal from the external terminal and each of the first input signal and the second input signal is a pause signal.

20 Claims, 7 Drawing Sheets

100

REMOTE CONTROLLABLE LAUNDRY PROCESSING DEVICE AND CONTROL METHOD THEREOF

CROSS-REFERENCE TO RELATED APPLICATION

This application claims priority to and the benefit of Korean Patent Application No. 10-2019-0086424 filed in the Korean Intellectual Property Office on Jul. 17, 2019.

BACKGROUND OF THE INVENTION

Field of the Invention

The present disclosure relates to a remote controllable laundry processing device and a method of controlling the same. More specifically, the present disclosure relates to a laundry processing device and a method of controlling the same capable of improving user convenience by allowing the laundry processing device to be controlled through an external terminal or the laundry processing device regardless of whether the remote control is set or released when a door is locked.

Description of the Related Art

A laundry processing device is a device for processing laundry through various actions such as washing, dehydration and/or drying.

The laundry processing devices include a washing machine that washes laundry such as clothes or bedding using the emulsification of detergent, the water flow generated by the rotation of a washing tub or a washing blade, and a mechanical force exerted by the washing blade, a dryer that dries laundry by applying hot or cold air, a refresher that removes wrinkles of the clothes by applying steam, and the like. There is also a laundry processing device that combinedly offers multiple functions, such as laundry processing devices for drying.

In accordance with a tendency to combine the functions of the laundry processing device, types of clothes, and a tendency to diversify user preferences, a remote controllable laundry processing device capable of controlling the laundry processing device from the outside through an external terminal has been recently developed.

However, according to a related art control method of the remote controllable laundry processing device, the related art method was able to remotely control the laundry processing device through the external terminal only when setting the remote control through a remote control setting unit included in the laundry processing device.

Accordingly, because the related art method cannot control the laundry processing device in operation through the external terminal when the user goes out without setting the remote control, it has a problem that it is impossible to control the laundry processing device through the external terminal when the user wants to change options such as adding one rinse.

Further, in a state of setting the remote control, it was impossible to control the laundry processing device through a manipulation unit included in the laundry processing device, and the manipulation can merely turn off and release the remote control setting in the laundry processing device.

Therefore, if a third party in the place where the laundry processing device is installed wants to put additional clothes in the laundry processing device, there is a problem that he/she has to turn off the laundry processing device, put the additional clothes in the laundry processing device, and then restart the laundry processing device, or he/she has to reset the remote control after releasing the remote control setting.

As described above, the related art control method of the remote controllable laundry processing device is not undesirable in terms of user convenience.

SUMMARY OF THE INVENTION

The present disclosure provides a laundry processing device and a method of controlling the same capable of improving user convenience by allowing the laundry processing device to be controlled through an external terminal or the laundry processing device regardless of whether the remote control is set or released when a door is locked.

In one aspect, there is provided a remote controllable laundry processing device comprising a cabinet main body including a door for putting and discharging a laundry; a sensor unit configured to sense a locked state of the door; a manipulation unit provided for user input; a remote control setting unit configured to perform a control of the laundry processing device based on an external terminal; a controller configured to control an overall operation of the laundry processing device; and a communication unit configured to send a signal input through the external terminal to the controller, wherein when the door is in the locked state, the controller is configured to control the laundry processing device in response to a first input signal input through the manipulation unit and a second input signal input through the external terminal, regardless of whether or not a remote control has been set by the remote control setting unit.

Each of the first input signal and the second input signal may be a pause signal. The controller may give a control authority to one, to which the pause signal is input, among the manipulation unit and the external terminal.

The remote controllable laundry processing device may further comprise a voice signal input unit configured to receive a voice signal of a user. In this case, the controller may handle and process the voice signal received through the voice signal input unit in the same manner as an input signal input through the external terminal.

The present disclosure can control the laundry processing device through the external terminal or the laundry processing device, regardless of the remote control setting/release when the door is in the locked state, i.e., when the laundry processing is performed by the laundry processing device.

Thus, even if a consumer does not set the remote control, the remote control is automatically set when the door is in the locked state.

In the present disclosure, the authority to first run the product (the laundry processing device) depends on the remote control setting/release state.

That is, the present disclosure can first run the product in response to a start signal input through the manipulation unit when the remote control is released (or unset), and can control the product (the laundry processing device) through the external terminal (or a voice input unit) and the manipulation unit while the door maintains the locked state according to the operation of the product.

Further, the present disclosure can first run the product in response to a start signal input through the external terminal (or the voice input unit) when the remote control is set, and can control the product (the laundry processing device) through the external terminal (or the voice input unit) and the manipulation unit while the door maintains the locked state according to the operation of the product.

Accordingly, the present disclosure can improve the user convenience.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

DETAILED DESCRIPTION OF THE EMBODIMENTS

Figure 1:
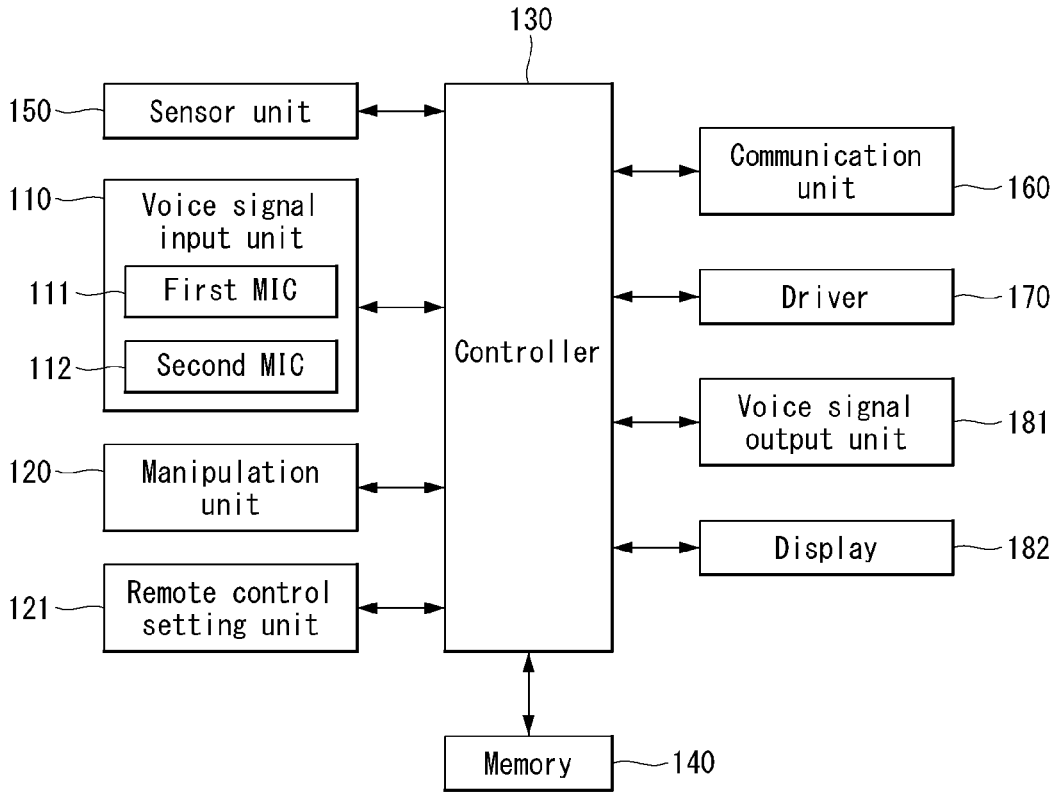
FIG. 1 illustrates an example of an internal block diagram of a laundry processing device according to an embodiment of the present disclosure.

Reference will now be made in detail embodiments of the disclosure examples of which are illustrated in the accompanying drawings. Since the present disclosure may be modified in various ways and may have various forms, specific embodiments are illustrated in the drawings and are described in detail in the present disclosure. However, it should be understood that the present disclosure are not limited to specific disclosed embodiments, but include all modifications, equivalents and substitutes included within the spirit and technical scope of the present disclosure.

The terms "first", "second", etc. may be used to describe various components, but the components are not limited by such terms. The terms are used only for the purpose of distinguishing one component from other components.

For example, a first component may be designated as a second component, and a second component may be designated as a first component without departing from the scope of the present disclosure.

The term "and/or" encompasses both combinations of the plurality of related items described and any item from among the plurality of related items disclosed.

It can be understood that when a component is described as being "connected to" or "coupled to" other component, it may be directly connected or coupled to the other component or intervening component(s) may be present.

On the other hand, it can be understood that when a component is described as being "directly connected to" or "directly coupled to" other component, there is no component between them.

The terms used in the present disclosure are used to describe only specific embodiments or examples, and are not intended to limit the present disclosure. A singular expression can include a plural expression as long as it does not have an apparently different meaning in context.

In the present disclosure, the terms "include" and "have" can be understood to be intended to designate that features, numbers, steps, operations, components, parts or combinations thereof exist and not to preclude the existence of one or more different features, numbers, steps, operations, components, parts or combinations thereof, or the possibility of the addition thereof.

Unless otherwise specified, all of the terms which are used herein, including the technical or scientific terms, have the same meanings as those that are generally understood by a person having ordinary skill in the art to which the present disclosure pertains.

The terms defined in a generally used dictionary can be understood to have meanings identical to those used in the context of a related art, and are not to be construed to have ideal or excessively formal meanings unless they are obviously specified in the present disclosure.

The following example embodiments of the present disclosure are provided to those skilled in the art in order to describe the present disclosure more completely. Accordingly, shapes and sizes of elements shown in the drawings may be exaggerated for clarity.

A laundry processing device according to an embodiment of the present disclosure is described below with reference to FIGS. 1 and 2.

A laundry processing device 100 may include a cabinet main body 211 having a door 215 for putting and discharging laundry, a sensor unit 150 for sensing a locked state of the door 215, a manipulation unit 120 provided for user input, a remote control setting unit 121 that allows a user to control the laundry processing device 100 through an external terminal (e.g., mobile phone, PDA, remote controller, etc.) such as a cellular phone or an application installed in the external terminal without going through the manipulation unit 120, a controller 130 that controls the overall operation of the laundry processing device 100, a communication unit 160 that sends a signal input through the external terminal to the controller 130, a voice signal input unit 110 that receives a voice command of the user, a memory 140 that stores various data, a driver 170 that performs operations implemented in the laundry processing device 100, a voice signal output unit 181 that outputs predetermined information through audio (voice), and a display 182 that displays predetermined information through video.

The laundry processing device 100 may not include at least some of the components described above.

The voice signal input unit 110 may receive an external audio signal and a user voice command. The voice signal input unit 110 may include one or more microphones (MICs).

To receive more accurately the user voice command, the voice signal input unit 110 may include a plurality of microphones 111 and 112.

The plurality of microphones 111 and 112 may be disposed to be spaced apart from each other at different locations, obtain the external audio signal, and process the external audio signal into an electrical signal.

Figure 2:
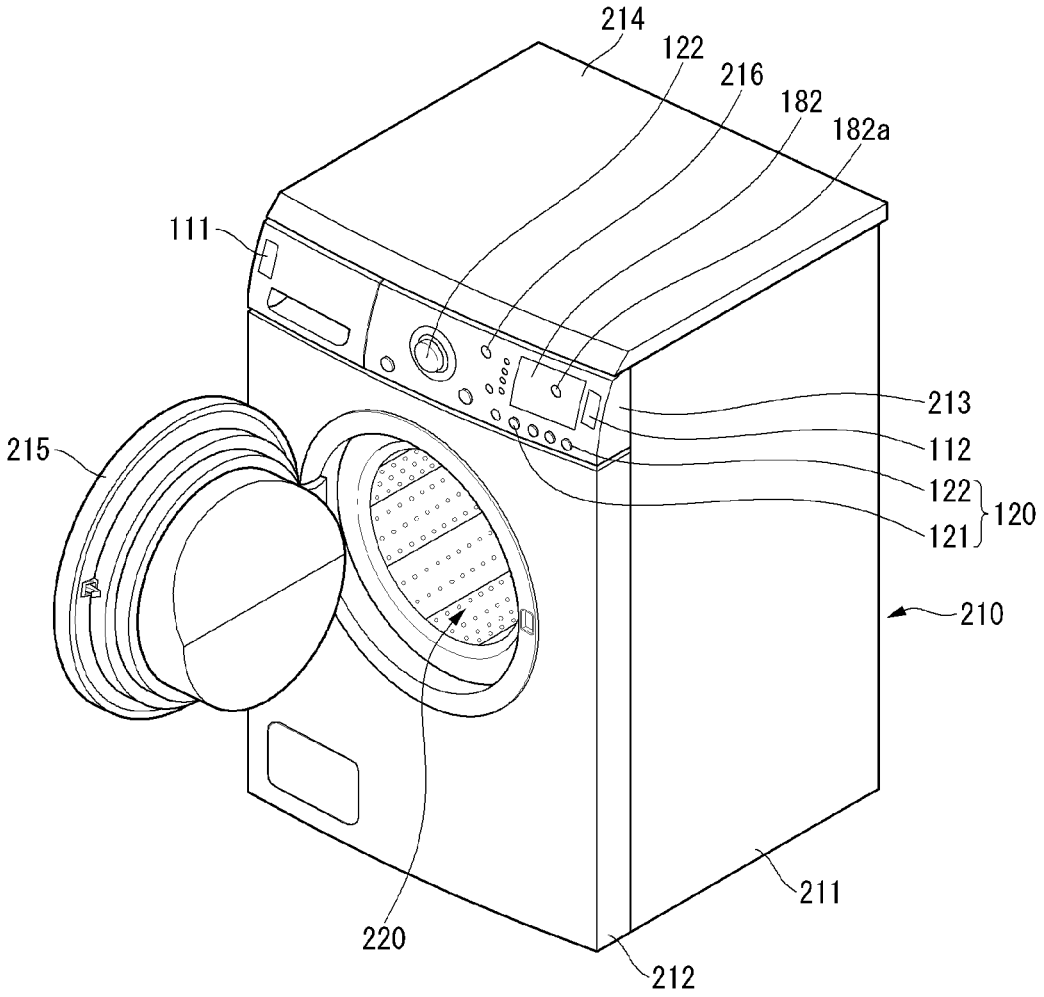
FIG. 2 is a perspective view of a laundry processing device according to an embodiment of the present disclosure.

FIGS. 1 and 2 illustrate that the voice signal input unit 110 includes two microphones including the first microphone 111 and the second microphone 112, by way of example. However, the present disclosure is not limited thereto.

The voice signal input unit 110 may include a processing unit that converts an analog sound into digital data. Alternatively, the voice signal input unit 110 may be connected to the processing unit and datarize a user input voice command so that the user input voice command can be recognized by the controller 130 or a predetermined external server (e.g., a voice server of a voice recognition server system).

The voice signal input unit 110 may include various noise reduction algorithms for removing a noise generated in a process of receiving the user voice command.

The voice signal input unit 110 may include a filter that removes a noise from the audio signals received from the respective microphones 111 and 112, an amplifier that amplifies and outputs a signal output from the filter, other components processing the audio signals, etc.

The memory 140 records a variety of information required in the operation of the laundry processing device 100, and may include a volatile or nonvolatile recording medium.

The recording medium stores data that can be read by a microprocessor, and may include a hard disk drive (HDD), a solid state disk (SSD), a silicon disk drive (SDD), ROM, RAM, CD-ROM, a magnetic tape, a floppy disk, an optical data storage device, and the like.

The memory 140 may store data for voice recognition, and the controller 130 may process the user's voice input signal received through the voice signal input unit 110 and perform a voice recognition process.

The simple voice recognition may be performed by the laundry processing device 100, and high-level voice recognition such as natural language processing may be performed by an external voice recognition server system.

For example, when a wake-up voice signal including a preset wake-up word is received, the laundry processing device 100 may be switched to a state for receiving the voice command.

In this case, the laundry processing device 100 may perform only a voice recognition process up to whether or not a wake-up word voice is input, and voice recognition for a subsequent user voice input may be performed by the voice recognition server system.

The memory 140 may store limited data. For example, the memory 140 may store data for recognizing the wake-up voice signal including the preset wake-up word.

In this case, the controller 130 may recognize the wake-up voice signal including the preset wake-up word from the user's voice input signal received through the voice signal input unit 110.

The wake-up word may be set by the manufacturer. In the laundry processing device 100, "LG Tromm" may be set as the wake-up word. The wake-up word may be changed by the user.

The controller 130 may send the user's voice command, that is input after recognizing the wake-up voice signal, to the external voice recognition server system through the communication unit 160.

The communication unit 160 may include one or more communication modules and exchange various signals with other electronic devices by performing wireless communication with the other electronic devices.

The communication unit 160 may communicate with an access point device and access a wireless Internet network through the access point device to communicate with other devices.

The controller 130 may transmit state information of the laundry processing device 100, the user's voice command, etc. to the external voice recognition server system, etc. through the communication unit 160.

When a control signal is received through the communication unit 160, the controller 130 may control the laundry processing device 100 to operate in response to the received control signal.

The voice signal output unit 181 may output an alert message such as a warning sound, an operation mode, an operation state, and an error state, information corresponding to the user's command input, a processing result corresponding to the user's command input, etc. through audio under the control of the controller 130.

The voice signal output unit 181 may convert an electrical signal from the controller 130 into an audio signal and output the audio signal. To this end, the voice signal output unit 181 may include a speaker and the like.

The display 182 may display information corresponding to the user's command input, a processing result corresponding to the user's command input, an operation mode, an operation state, an error state, etc. through video.

The display 182 may include a touch screen. In this case, the display 182 may be used as an input device capable of inputting information by a user's touch, in addition to the output device.

The laundry processing device 100 may provide user experience (UX) considering various situations that may be generated during the voice recognition process and the control process of the laundry processing device.

The controller 130 may control the voice signal output unit 181 and the display 182 so that predetermined information is provided to the user through visual/auditory means in the voice recognition process and each step of the control process of the laundry processing device.

The controller 130 may control the display 182 to provide visual information in the voice recognition process and each step of the control process of the laundry processing device.

The controller 130 may control the voice signal output unit 181 to provide auditory information in the voice recognition process and each step of the control process of the laundry processing device.

The driver 170 performs operations implemented in the laundry processing device 100, and may include a motor controller that applies an operation control signal to a motor driving a drum or a tub, and the like.

The controller 130 may perform a washing stroke, a rinsing stroke, and a dehydration stroke according to a preset algorithm, and the driver 170 may drive loads such as a motor, a water supply valve, and a drain valve under the control of the controller 130.

The driver 170 may control an operation so that the laundry processing device 100 performs a set operation in response to a control signal applied from the controller 130. Hence, the laundry processing device 100 can perform a series of strokes including the washing stroke, the rinsing stroke, and the dehydration stroke to decontaminate laundry.

The laundry processing device 100 may further include the manipulation unit 120 for user input and the sensor unit 150 including one or more sensors that sense a variety of data.

The manipulation unit 120 may include a plurality of manipulation buttons and send a signal corresponding to the input button to the controller 130.

The manipulation unit 120 may include the remote control setting unit 121, for example, a remote control setting button 121 that allows the user to control the laundry processing device 100 through the external terminal or an application installed in the external terminal without going through the manipulation unit 120.

However, the remote control setting button 121 may be spaced apart from various keys or buttons of the manipulation unit 120 and may be separately provided.

The sensor unit 150 may include at least one sensing means for sensing a temperature, a pressure, a voltage, a current, a water level, the number of revolutions, etc., and transmit the sensed or measured data to the controller 130.

For example, the sensor unit 150 may measure a water level when the laundry processing device 100 waters or drains, and measure a temperature of the water supplied, a rotation speed of the washing tub or the drum, and the like.

The sensor unit 150 may include a sensor 151 that senses locked and unlocked states of the door 215 included in the cabinet main body 211 of the laundry processing device 100.

The embodiment described that the sensor 151 senses the locked and unlocked states of the door 215, but the sensor 151 may sense a closed state and an open state of the door 215. In the following description, the locked/unlocked state of the door may be understood as the closed/open state of the door.

The laundry processing device 100 may include a cabinet 210, a tub 220 that is disposed in the cabinet 210, receives laundry and is rotatable, a motor (not shown) for driving the tub 220, a washing water supply device (not shown) that supplies washing water to the tub 220, and a draining device (not shown) that discharges washing water to the outside after the washing is finished.

The cabinet 210 may include the cabinet main body 211, a cabinet cover 212 that is disposed in front of the cabinet main body 211 and coupled to the cabinet main body 211, a control panel 213 that is disposed on the cabinet cover 212 and controls the operation of the laundry processing device 100, and a top plate that is disposed on the control panel 213 and coupled to the cabinet main body 211.

The cabinet cover 212 may include a hole (not shown) through the laundry enters, and the door 215 that operates to open and close the hole.

The control panel 213 may include the manipulation unit 120 including a plurality of manipulation keys 122 manipulating the operation of the laundry processing device 100, the voice signal output unit 181 (see FIG. 1) that outputs the operation state of the laundry processing device 100 though a signal sound, and a display panel 182 that displays the operation state of the laundry processing device 100 through characters, numbers, special symbols, images, etc.

The microphones 111 and 112 receiving the user's voice command may be disposed on the control panel 213. Alternatively, the microphones 111 and 112 may be disposed at a different position suitable to receive the voice command.

The microphones 111 and 112 may receive the external audio signal and the user voice command. Further, the microphones 111 and 112 may obtain the external audio signal and the user voice command and process them into electrical signals.

The voice signal output unit 181 (see FIG. 1) may output audio signals such as various sound effects and voice guidance messages. To this end, the voice signal output unit 181 may include a speaker, and the like.

The audio signal output from the voice signal output unit 181 may be output to the outside through a sound guidance portion formed on a rear surface of the control panel 213 and a gap of a portion on which the manipulation keys 122 are formed.

When a separate output hole 216 is provided, the sound output from the voice signal output unit 181 may be output to the outside through the output hole 216.

FIG. 2 illustrates an example of the laundry processing device 100, by way of example, and the present disclosure is not limited thereto.

For example, the laundry processing device 100 may be implemented in a top load manner.

The laundry processing device 100 may be a dry laundry processing device providing both washing and dry functions.

The manipulation unit 120 may send the signal of the manipulation keys 122 to the controller 130.

The manipulation keys 122 may include a button, a dome switch, a touch pad (static pressure/capacitive or electrostatic), a jog wheel, a jog switch, a finger mouse, a rotary switch, a jog dial, and the like. The manipulation key 122 can apply any device as long as it is a device that generates predetermined input data by operations such as pressing, rotation, pressure, and contact.

The manipulation unit 120 may further include the remote control setting unit, for example, the remote control setting button 121 that allows the user to control the laundry processing device 100 through the external terminal without going through the manipulation unit 120.

However, the remote control setting button 121 may be spaced apart from various keys or buttons of the manipulation unit 120 and may be separately provided.

The display panel 182 may display information input by the manipulation unit 120 and the manipulation keys 122, operation state information of the laundry processing device 100, and information according to the operation completion of the laundry processing device 100 on the screen in response to a control command of the controller 130.

When the laundry processing device 100 malfunctions, the display panel 182 may display failure information about the malfunction.

The display panel 182 may display the washing setting and an operation state through at least one combination of character, image, icon, and special character on the screen, and display various notifications according to the operation state.

The display panel 182 may further include a remote control display, for example, a remote control display lamp 182*a* indicating remote control setting/release states.

However, the remote control display lamp 182*a* may be provided separately from the display panel 182.

The laundry processing device having the above-described configuration may operate according to the following method.

The laundry processing device 100 may receive a voice input through the microphones 111 and 112 and transmit voice data corresponding to the voice input to an external voice server.

The laundry processing device 100 may activate a voice recognition function by a user input. Depending on the user input, the controller 130 of the laundry processing device 100 may activate the microphones 111 and 112.

Alternatively, the laundry processing device 100 may automatically activate a voice recognition function according to the setting for the activation of the voice recognition function.

For example, when the laundry processing device 100 is turned on, the laundry processing device 100 may automatically activate the microphones 111 and 112 and activate the voice recognition function.

When a voice input is received from the user in a state in which the microphones 111 and 112 of the laundry processing device 100 are activated, the microphones 111 and 112 may receive the input voice and send it to the controller 130.

The laundry processing device 100 may wait for a preset wake-up word input as the voice recognition function is activated.

When the preset wake-up word is received through the microphones 111 and 112, the laundry processing device 100 may switch to a voice input standby mode for receiving a user's voice command.

If the laundry processing device 100 always waits for a natural language command, this is burden on power consumption and CPU occupied rate in the voice recognition function, and the server load of the voice recognition sever system.

Thus, the laundry processing device 100 may send the voice server only a voice signal that is input in the voice input standby mode.

The laundry processing device 100 may give conditions to a voice input standby time and receive sound up to a command completion time when a command is input in time to send the sound to the voice service.

The laundry processing device 100 may perform only a voice recognition process up to whether or not a wake-up word voice is input, and voice recognition for a subsequent user voice input may be performed by the voice recognition server system.

The controller 130 may send the external voice recognition server system a user's voice input, that is input after recognizing the wake-up word, through the communication unit 160.

The laundry processing device 100 may communicate with the external voice server through the communication unit 160 and transmit voice data corresponding to the user's voice input to the voice server.

Waiting indefinitely for a user's voice command may waste system resources and does not meet a user's intention of not inputting the command. Therefore, the laundry processing device 100 may be configured to process only a voice command, which is input for a predetermined elapse time, in a command standby mode.

In this case, the controller 130 may transmit, to the voice server, voice data including a voice input received within the predetermined elapse time.

If the voice command is not received within the predetermined elapse time, the controller 130 may control to wait for the input of the wake-up word again.

The voice server and the voice recognition server system including the voice server may recognize and process voice data including the voice input received from the laundry processing device 100.

Hence, if the communication unit 160 receives, from the external server, a control signal based on the voice input, the controller 130 may control the laundry processing device 100 to operate in response to the received control signal.

Further, if the communication unit 160 receives, from the voice server, voice recognition result information based on a voice recognition result of the voice data, the controller 130 may control the voice signal output unit 181 to output a voice guidance message corresponding to the received voice recognition result information.

The voice input received through the microphones 111 and 112 may include at least one of keywords indicating a washing time or the number of washes, a rinse time or the number of rinses, a dehydration time or the number of dehydrations, a cloth type, a dirty level, and a water temperature.

In the present disclosure, a washing course refers to a series of operations of the laundry processing device that is automatically performed according to preset conditions and order. The washing course may generally include a washing stroke, a rinsing stroke, and a dehydration stroke.

For example, various washing courses including functional clothes washing, lingerie washing, children's clothes washing, sterilization washing, wool washing, bedding washing, soak washing, boiled washing, baby clothes washing, etc. may be provided. Each washing course may be selected considering the user's washing purpose or types of clothes. The laundry processing device may be configured such that the washing process suitable for the washing purpose of each washing course is performed from the start to the end according to the preset conditions and order.

The manufacturer may pre-store, in the laundry processing device 100, data for operations of a plurality of washing courses that has been frequently used, and allow the laundry processing device 100 to run according to a specific washing course based on the pre-stored data, if necessary.

In the present disclosure, the plurality of pre-stored washing courses may be a plurality of standard washing courses in which each stroke is set as standard considering the washing purpose or the types of clothes.

In the laundry processing device 100 having the above-described configuration, when the door 215 is in the locked state (or when the laundry processing device 100 runs), the controller 130 controls the laundry processing device 100 in response to a first input signal input through the manipulation unit 120 and a second input signal input through the external terminal or the voice signal input unit, regardless of whether or not the remote control has been set by the remote control setting button 121.

In the present disclosure, each of the first input signal and the second input signal refers to a pause signal.

Figure 3:
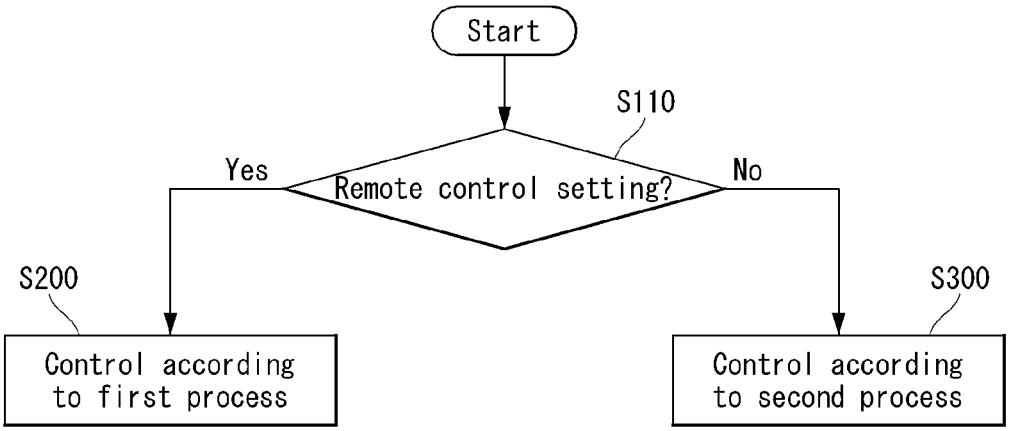
FIG. 3 is a flow chart illustrating a method of controlling a laundry processing device according to an embodiment of the present disclosure.

A method of controlling a laundry processing device according to an embodiment of the present disclosure is described below with reference to FIGS. 3 to 5.

The control method according to an embodiment of the present disclosure includes a step S110 of sensing a remote control setting/release.

If the remote control setting is sensed in the step S110, the controller 130 proceeds to a step S200 and controls the laundry processing device 100 according to a first process. If the remote control setting is not sensed in the step S110, i.e., if the remote control is not set, the controller 130 proceeds to a step S300 and controls the laundry processing device 100 according to a second process.

According to the second process, even if the user does not set the remote control, the remote control is automatically set in a locked state of the door (or a running state of the laundry processing device 100).

The control method according to the first process is first described. The controller 130 senses whether or not a first start signal is input through the external terminal or the voice signal input unit in S210.

Here, the 'first start signal' means a start signal that is first input in a power-on state.

If the user sets the remote control using the remote control setting button, the door 215 maintains the locked state, and the remote control display lamp 182*a* displays a remote control setting state.

If the first start signal is input in the step S210, the controller 130 controls the driver 170 to run the laundry processing device 100, thereby processing the laundry in S220.

The controller 130 senses whether or not the first input signal and the second input signal are input during the running of the laundry processing device 100.

That is, the first input signal may be input or the second input signal may be input during the running of the laundry processing device 100.

The case in which the second input signal is input is first described. The controller 130 senses whether or not the second input signal (pause signal) is input through the external terminal or the voice signal input unit, in S230. If the input of the second input signal is sensed in the step S230, the controller 130 receives a control command through the external terminal or the voice signal input unit in a state of maintaining the door locking and the remote control setting display, in S240.

As described above, if the second input signal is input through the external terminal or the voice signal input unit, in this state, the laundry processing device 100 can be controlled only through the external terminal or the voice signal input unit and cannot be controlled through the manipulation unit.

Subsequently, if the user inputs a start signal through the external terminal or the voice signal input unit in S250, the controller 130 runs again the laundry processing device 100 and processes the laundry in S260. In some implementations, the controller 130 may be controllable only by the external terminal or the voice signal input unit until the start signal is input from the external terminal or the voice signal input unit in S250.

If the first input signal (pause signal) through the manipulation unit 120 not the second input signal through the external terminal is input during the running of the laundry processing device 100 in S270, the controller 130 receives a control command through the manipulation unit 120 in a state of releasing the door locking and the remote control setting display, in S280.

As described above, if the first input signal is input through the manipulation unit 120, in this state, the laundry processing device 100 can be controlled only through the manipulation unit 120 and cannot be controlled through the external terminal or the voice signal input unit.

If the start signal is input through the manipulation unit 120 in S290, the laundry is processed in S295. In some implementations, the controller 130 may be controllable only by the manipulation unit until the start signal is input from the manipulation unit in S290.

Next, the case in which the first input signal is input during the processing of laundry in the step S220 is described.

The controller 130 senses whether or not the first input signal (pause signal) is input through the manipulation unit 120, in S230A. If the input of the first input signal is sensed in the step S230A, the controller 130 releases the door locking and the remote control setting display in S240A. The controller 130 may control the display panel 182 or the remote control display lamp 182*a* to display an indicator providing a remote control state being releasing in S240A.

As described above, if the first input signal is input through the manipulation unit 120, in this state, the laundry processing device 100 can be controlled only through the manipulation unit 120 and cannot be controlled through the external terminal or the voice signal input unit.

Subsequently, if the user inputs a start signal through the manipulation unit 120 in S250A, the controller 130 runs again the laundry processing device 100 and processes the laundry in S260A.

If the second input signal (pause signal) through the external terminal or the voice signal input unit not the first input signal through the manipulation unit is input during the running of the laundry processing device 100 in S270A, the controller 130 maintains the door locking and the remote control setting display in S280A.

As described above, if the second input signal is input through the external terminal or the voice signal input unit, in this state, the laundry processing device can be controlled only through the external terminal or the voice signal input unit and cannot be controlled through the manipulation unit.

If the start signal is input through the external terminal or the voice signal input unit in S290A, the laundry is processed in S295A.

Next, a method of controlling the laundry processing device 100 according to the second process is described below.

If the remote control setting is not sensed in the step S110, i.e., if the remote control is not set, the controller 130 senses whether or not the first start signal is input through the manipulation unit 120 in S310.

If the first start signal is input in the step S310, the controller 130 locks the door 215, controls the driver 170 to process the laundry by driving the laundry processing device 100, and automatically sets the remote control in S320. The controller 130 may control the display panel 182 or the remote control display lamp 182*a* to display an indicator providing a remote control state being setting in S320.

The controller 130 senses whether or not the first input signal and the second input signal are input during the running of the laundry processing device 100.

That is, the first input signal may be input or the second input signal may be input during the running of the laundry processing device 100.

The case in which the first input signal is input is first described. The controller 130 senses whether or not the first input signal (pause signal) is input through the manipulation unit 120, in S330. If the input of the first input signal is sensed in the step S330, the controller 130 receives a control command through the manipulation unit 120 in a state of releasing the door locking and the remote control setting display, in S340. The controller 130 may control the display panel 182 or the remote control display lamp 182*a* to display an indicator providing a remote control state being releasing in S340.

Subsequently, if the user inputs a start signal through the manipulation unit 120 in S350, the controller 130 locks the door 215, displays the remote control setting, and runs again the laundry processing device 100 to process the laundry in S360. In some implementations, the controller 130 may be controllable only by the manipulation unit 120 until the start signal is input from the manipulation unit in S350.

If the second input signal (pause signal) through the external terminal or the voice signal input unit not the first input signal through the manipulation unit 120 is input during the running of the laundry processing device 100 in S370, the controller 130 receives a control command through the external terminal or the voice signal input unit in a state of maintaining the door locking and the remote control setting display, in S380.

If the start signal is input through the external terminal or the voice signal input unit in S390, the laundry is processed in S395. In some implementations, the controller 130 may be controllably only by the external terminal or the voice signal input unit until the start signal is input from the external terminal or the voice signal input unit in S390.

Next, the case in which the second input signal is input during the processing of laundry in the step S320 is described.

The controller 130 senses whether or not the second input signal (pause signal) is input through the external terminal or the voice signal input unit, in S330A. If the input of the second input signal is sensed in the step S330A, the controller 130 receives a control command through the external terminal or the voice signal input unit in a state of maintaining the door locking and the remote control setting display, in S340A.

Subsequently, if the user inputs a start signal through the external terminal or the voice signal input unit in S350A, the controller 130 runs again the laundry processing device 100 and processes the laundry in S360A.

If the first input signal (pause signal) through the manipulation unit 120 not the second input signal through the external terminal is input during the running of the laundry processing device 100 in S370A, the controller 130 receives a control command through the manipulation unit 120 in a state of releasing the door locking and the remote control setting display, in S380A.

If the start signal is input through the manipulation unit 120 in S390A, the laundry is processed in S395A.

Figure 4:
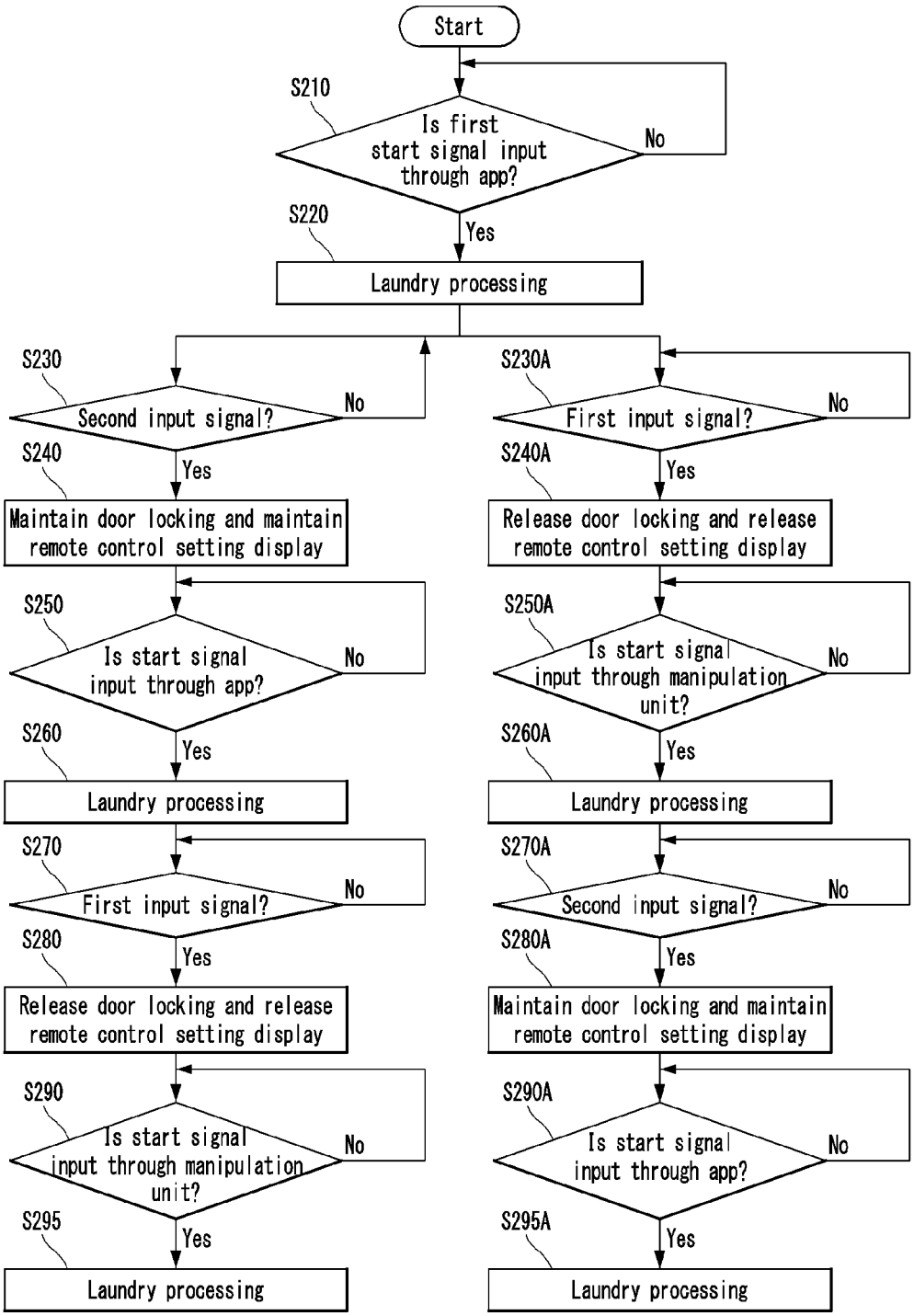
FIG. 4 is a flow chart illustrating a control method according to a first process illustrated in FIG. 3.
Figure 6:
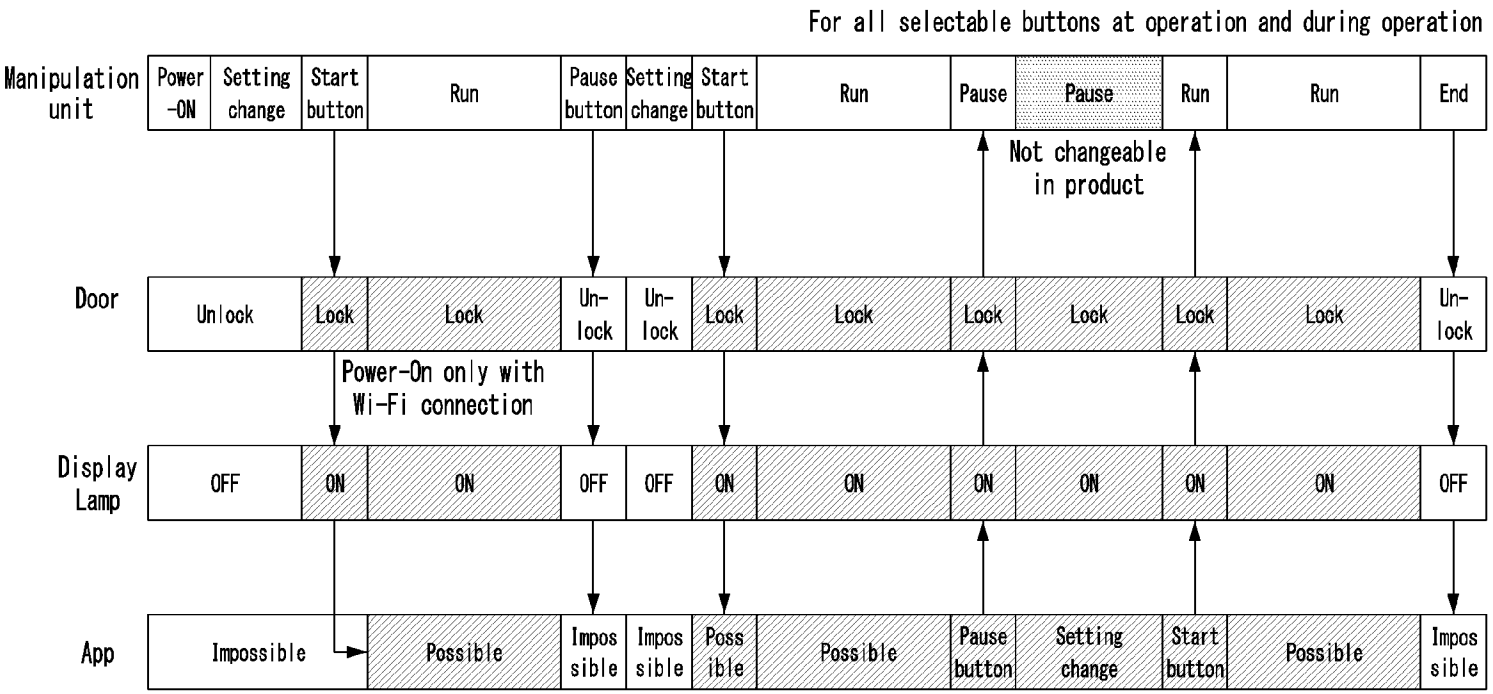
FIG. 6 illustrates controllable/uncontrollable state of the product through a manipulation unit, locked/unlocked state of a door, remote control setting/release state, controllable/uncontrollable state of the product through an external terminal in a remote control setting state according to the flow chart illustrated in FIG. 4.

FIG. 6 illustrates controllable/uncontrollable state of the product through a manipulation unit 120, locked/unlocked state of a door 215, remote control setting/release state, controllable/uncontrollable state of the product through an external terminal in a remote control setting state according to the flow chart illustrated in FIG. 4.

Figure 5:
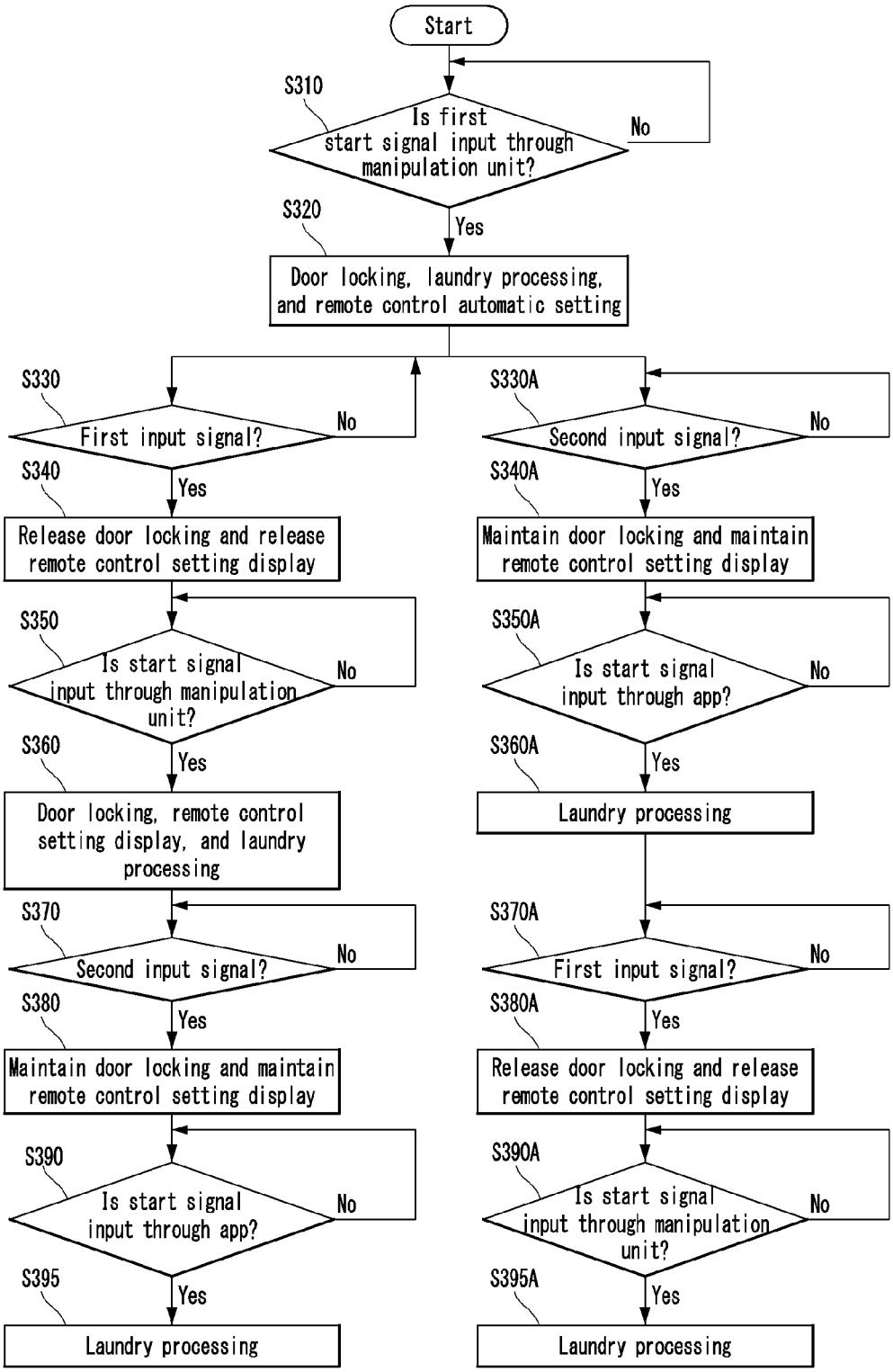
FIG. 5 is a flow chart illustrating a control method according to a second process illustrated in FIG. 3.
Figure 7:
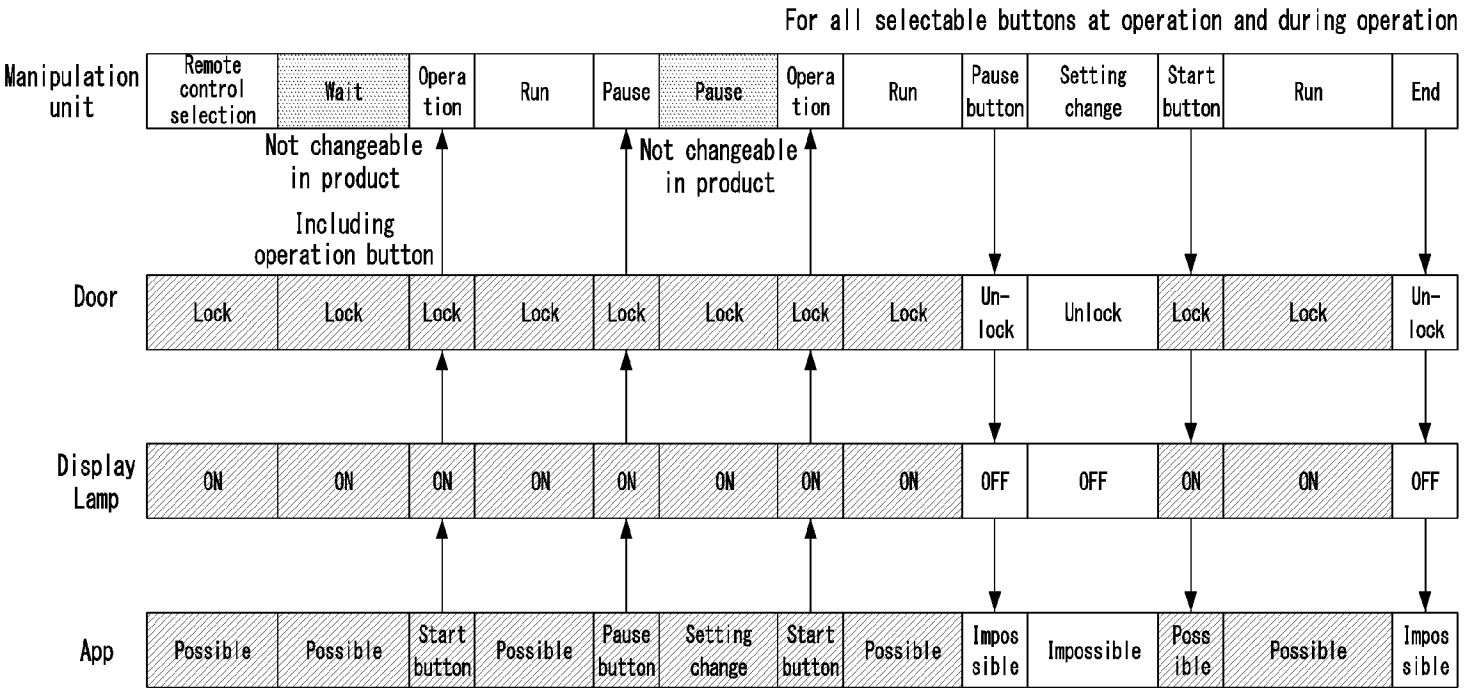
FIG. 7 illustrates controllable/uncontrollable state of the product through a manipulation unit, locked/unlocked state of a door, remote control setting/release state, controllable/uncontrollable state of the product through an external terminal in a remote control unsetting state according to the flow chart illustrated in FIG. 5.

FIG. 7 illustrates controllable/uncontrollable state of the product through a manipulation unit 120, locked/unlocked state of a door 215, remote control setting/release state, controllable/uncontrollable state of the product through an external terminal in a remote control unsetting state according to the flow chart illustrated in FIG. 5.

What is claimed is:

1. A remote controllable laundry processing device comprising:

a cabinet main body including a door;

a sensor unit configured to sense a locked state of the door;

a manipulation unit provided for user input;

a remote control setting unit configured to control the laundry processing device based on an external terminal;

a controller configured to control an operation of the laundry processing device; and a communication unit configured to send the controller an input signal from the external terminal, wherein the controller is configured, based on the door being in the locked state and regardless of whether a remote control has been set by the remote control setting unit, to control the laundry processing device in response to a first input signal from the manipulation unit and a second input signal from the external terminal, and wherein each of the first input signal and the second input signal is a pause signal.

2. The remote controllable laundry processing device of claim 1, wherein the controller is configured to give a control authority to one of the manipulation unit or the external terminal associated with the pause signal.

3. The remote controllable laundry processing device of claim 2, wherein the controller is configured, based on a state of the remote control being unsetting and the first input signal being input from the manipulation unit, to release the locking of the door and be controllable only by the manipulation unit until a start signal is input from the manipulation unit.

4. The remote controllable laundry processing device of claim 3, wherein the controller is configured, based on the state of the remote control being unsetting and the second input signal being input from the external terminal, to maintain the locking of the door and be controllable only by the external terminal until the start signal is input from the external terminal.

5. The remote controllable laundry processing device of claim 2, wherein the controller is configured, based on a state of the remote control being setting and the second input signal being input from the external terminal, to maintain the locking of the door and be controllable only by the external terminal until a start signal is input from the external terminal.

6. The remote controllable laundry processing device of claim 5, wherein the controller is configured, based on the state of the remote control being setting and the first input signal being input from the manipulation unit, to release the locking of the door and be controllable only by the manipulation unit until the start signal is input from the manipulation unit.

7. The remote controllable laundry processing device of claim 1, further comprising a remote control display unit, wherein the controller is configured to control the remote control display unit to display whether or not the remote control has been set.

8. The remote controllable laundry processing device of claim 7, wherein the controller is configured, based on a state of the remote control being unsetting and a start signal being input from the manipulation unit, to control the remote control display unit to display a first indicator, the first indicator providing the state of the remote control being setting.

9. The remote controllable laundry processing device of claim 8, wherein the controller is configured, based on the first input signal being input from the manipulation unit, to control the remote control display unit to display a second indicator, the second indicator providing the state of the remote control being releasing.

10. The remote controllable laundry processing device of claim 7, wherein the controller is configured, based on a state of the remote control being setting and the first input signal being input from the manipulation unit, to control the remote control display unit to display an indicator, the indicator providing the state of the remote control being releasing.

11. The remote controllable laundry processing device of claim 1, further comprising a voice signal input unit configured to receive a voice signal, wherein the controller is configured to handle and process the voice signal received from the voice signal input unit in a same manner as an input signal from the external terminal.

12. A method of controlling a remote controllable laundry processing device, the method comprising:

sensing a locked state of a door by a sensor unit, the door included in a cabinet main body; and controlling the laundry processing device in response to a first input signal from a manipulation unit provided for user input and a second input signal from an external terminal based on the door being in the locked state and regardless of whether or not a remote control has been set by the manipulation unit, wherein each of the first input signal and the second input signal is a pause signal.

13. The method of claim 12, further comprising giving a control authority to one of the manipulation unit or the external terminal associated with the pause signal.

14. The method of claim 13, further comprising releasing the locking of the door and being controllable only by the manipulation unit until a start signal is input from the manipulation unit based on a state of the remote control being unsetting and the first input signal being input from the manipulation unit.

15. The method of claim 14, further comprising maintaining the locking of the door and being controllable only by the external terminal until the start signal is input from the external terminal based on the state of the remote control being unsetting and the second input signal being input from the external terminal.

16. The method of claim 13, further comprising maintaining the locking of the door and being controllable only by the external terminal until a start signal is input from the external terminal based on a state of the remote control being setting and the second input signal is input from the external terminal.

17. The method of claim 16, further comprising releasing the locking of the door and being controllable only by the manipulation unit until the start signal is input from the manipulation unit based on the state of the remote control being setting and the first input signal being input from the manipulation unit.

18. The method of claim 13, further comprising:

displaying an indicator through a remote control display unit based on a state of the remote control being unsetting, wherein the indicator provides a state of the remote control as setting based on a start signal being input from the manipulation unit, and wherein the indicator provides the state of the remote control as releasing based on the first input signal being input from the manipulation unit.

19. The method of claim 13, further comprising:

displaying an indicator through a remote control display unit based on a state of the remote control being setting and the first input signal being input from the manipulation unit, wherein the indicator provides a state of the remote control as releasing.

20. The method of claim 12, further comprising handling and processing a voice signal received from a voice signal input unit included in the cabinet main body in a same manner as an input signal received from the external terminal.

* * * * *